United States Patent [19]

Freiherr von Maltzan

[11] Patent Number: 4,949,619

[45] Date of Patent: Aug. 21, 1990

[54] SOUND PICKUP DEVICE FOR ACOUSTIC STRINGED INSTRUMENTS

[76] Inventor: Wolf-Ulrich Freiherr von Maltzan, Königsweg 3100, D-1000 Berlin 39, Fed. Rep. of Germany

[21] Appl. No.: 275,040

[22] PCT Filed: Feb. 8, 1988

[86] PCT No.: PCT/DE88/00055

§ 371 Date: Oct. 5, 1988

§ 102(e) Date: Oct. 5, 1988

[87] PCT Pub. No.: WO88/05952

PCT Pub. Date: Aug. 11, 1988

[30] Foreign Application Priority Data

Feb. 8, 1987 [DE] Fed. Rep. of Germany ..... 8702014
Sep. 1, 1987 [DE] Fed. Rep. of Germany ..... 8711963

[51] Int. Cl.[5] ..... G10H 3/18
[52] U.S. Cl. ..... 84/723; 84/743
[58] Field of Search ..... 84/1.01–1.16, 84/1.28, 267, DIG. 29, 723–728, 730, 731, 733, 734, 743

[56] References Cited

U.S. PATENT DOCUMENTS 4,018,127 4/1977 Biro ..... 84/1.28
4,182,214 1/1980 Wakeman ..... 84/1.28
4,748,886 6/1988 De Byl .

FOREIGN PATENT DOCUMENTS 2653862 6/1977 Fed. Rep. of Germany .
3413510A1 10/1984 Fed. Rep. of Germany .

*Primary Examiner*—Stanley J. Witkowski
*Attorney, Agent, or Firm*—Wenderoth, Lind & Ponack

[57] ABSTRACT

A sound pickup device for acoustic stringed instruments. A foam body mounts microphones and electronic circuitry associated therewith. The foam body has annular ridges projecting from opposite ends which will abut with the interior of the soundbox to mount the pickup device in the instrument. Recesses in the ends aid in collapsing the device for insertion into the soundbox and improve acoustic properties. In an alternative arrangement, the foam body is formed with a tubular shape. The electronic circuitry includes a battery pack for operation without a phantom power supply.

17 Claims, 10 Drawing Sheets

SOUND PICKUP DEVICE FOR ACOUSTIC STRINGED INSTRUMENTS

BACKGROUND OF THE INVENTION

The present invention relates to sound pickup devices for acoustic stringed instruments. The present invention constitutes a further development of the pickup device disclosed in W. German Utility Model No. G 84 31 266.1, which corresponds to U.S. Pat. No. 4,748,886, the so-called De Byl pickup, which includes a foam body for insertion into the soundbox. Microphones are mounted in the foam body for sound pickup.

SUMMARY OF THE INVENTION

On the basis of the vibration and resonance conditions underlying and discussed in W. German Utility Model No. G 84 31 266.1, it is the object of the invention to substantially improve on the acoustic conditions governing the pickup of sound in an acoustic stringed instrument, in particular an acoustic guitar. Thus it is sought to enhance the so-called De Byl effect by means of a particular design of the present pickup device and at the same time obtain a pickup device which is easier to handle and relatively inexpensive to manufacture.

The above objects are achieved by a sound pickup device having the following features. This invention uses a body of open-cell foam material which, because of its pore size and standard hardness, has specific acoustic properties and shields against the ingress of external sound through the sound hole.

A first embodiment includes concentric ridges, which are tapered in cross section, at the top and at the bottom of the foam body which result in line engagement with the soundbox so that the wall radiating sound into the air advantageously experiences less damping. Thus, any impairment of the natural tone of the soundbox by the use of the device is minimized as far as possible.

The foam body comprises two sections (a horizontal division) of which the upper one includes a central opening intended to receive a metal case housing the electronics. After this case and microphone capsules, connected thereto through leads, have been inserted into recesses provided therefor, the two sections are adhesively bonded to each other to create a closed-surface body from which only the leads protrude, i.e. the microphone capsules are not visible.

A second embodiment has an annular configuration for the foam body. The assembly of two microphones in the annular foam body at a mutual opening angle of 90° creates a stereo effect which is enhanced by the bisector of that angle extending in parallel with and between the two center strings of the guitar. The microphones lie symmetrically with respect to the bisector and are at the same time directed into the major portion of the soundbox.

BRIEF DESCRIPTION OF THE DRAWINGS

The following explanation of the invention is best understood when taken in conjunction with the drawings, wherein.

DETAILED DESCRIPTION OF THE INVENTION

The following description includes advantageous dimensions for the device when adapted for use with a guitar. While these dimensions have been found to produce advantageous results, they are not meant to be limiting.

Figure 1:
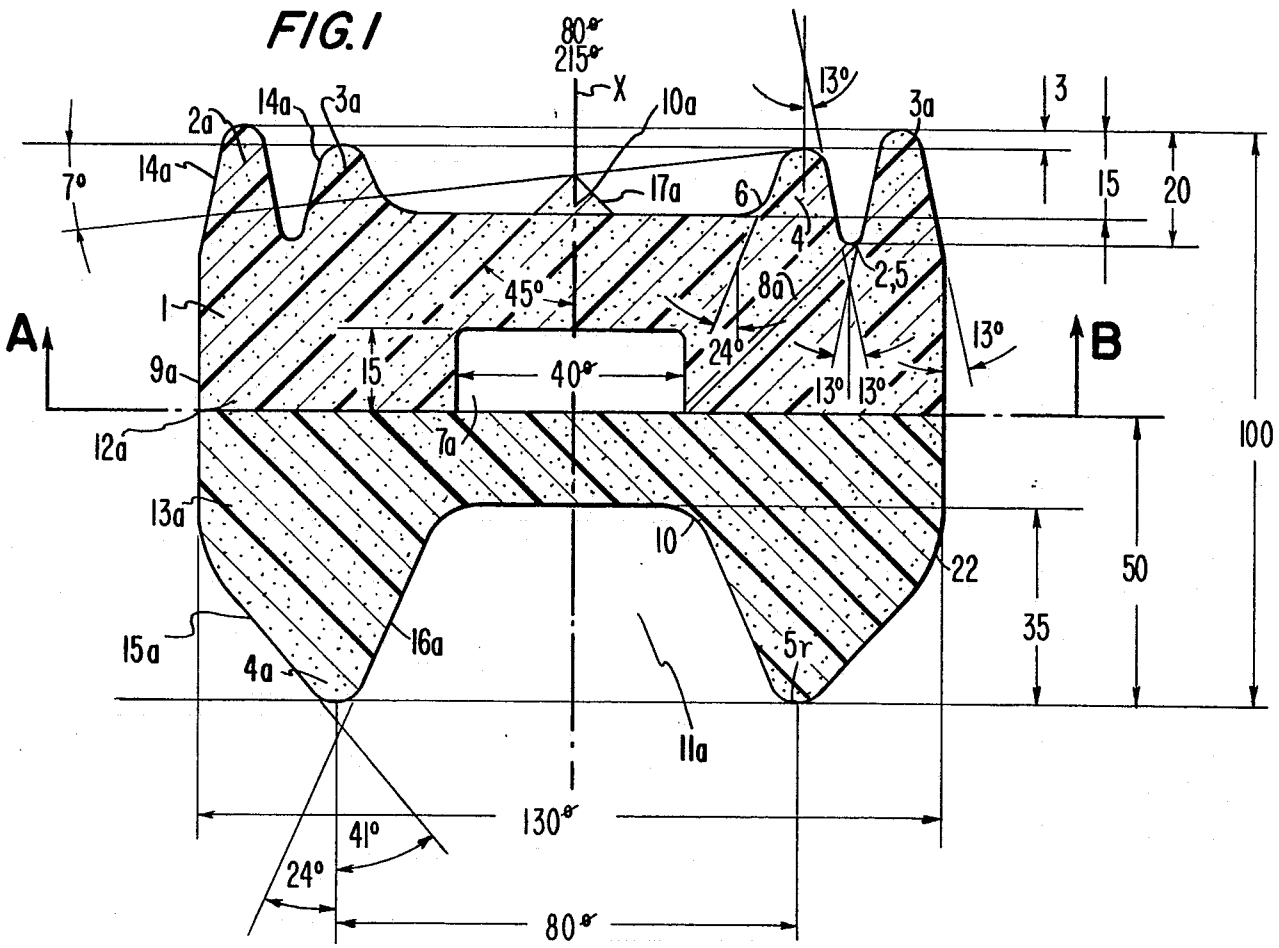
FIG. 1 is a cross section of the foam body in accordance with a first embodiment of the invention.

FIG. 1 shows a first embodiment of the device comprising a foam body 1. The body may have a diameter of 130 mm and a height of 100 mm, including the top outer and the bottom ridges 2*a* and 4*a* having a height of 20 mm and 35 mm, respectively. There also is provided a top inner ridge 3*a* having a height of 15 mm. Foam body 1 has a substantially cylindrical outer peripheral surface 9*a*. Top and bottom ridges 2*a*, 3*a* and 4*a* are concentric with vertical axis X of foam body 1, are conical in cross section and in the assembled condition are in line contact with the top or bottom walls of the soundbox. The concentric tapered ridges on the top of the device also act to center the device inside a guitar's sound hole and to secure it against displacement. While exerting minimum contact pressure, the concentric ridges on the top of the device provide an improved seal at the sound hole to attenuate the ingress of external noise into the soundbox, thus reducing feedback. The different heights of the concentric ridges on the top of the device also act to keep the inner ridge from protruding excessively from the sound hole and from disturbing the player. The inner ridge is tapered in cross section and thus may be seated in sound holes having different diameters.

Foam body 1 may be coated with velvet on its entire surface. The foam body is coated on its surface with velvet by means of a specialized electrostatic process to optimize the following factors: extended life of the foam material by protecting it against ultraviolet radiation from the sun, which otherwise would have negative effects; protection against mechanical abrasion to prevent fraying; improvement of acoustic properties; and improved appearance.

At its bottom, foam body 1 is conically recessed within conical ridge 4*a*. Conical surfaces 14*a* of top ridges 2a, 3a are inclined by 13° from vertical axis X of foam body 1. The outer and inner surfaces 15a and 16a, respectively, of tapered lower ridge 4a are inclined 41° and 24°, respectively, from the vertical axis. The contacting crests of top and bottom ridges 2a, 3a and 4a are rounded on 4 mm or 5 mm radii, respectively. Recess 11a at the bottom end surface of foam body 1 has a depth of 25 mm and a diameter of 80 mm between the crests of lower ridges 4a.

The tapered recess at the bottom of the foam body reduces its volume, facilitating its introduction in and removal from the sound hole. In contrast to a fully cylindrical shape, the lower volume of the body resulting from its configuration also reduces the volume vibrating inside the soundbox.

Figure 3:
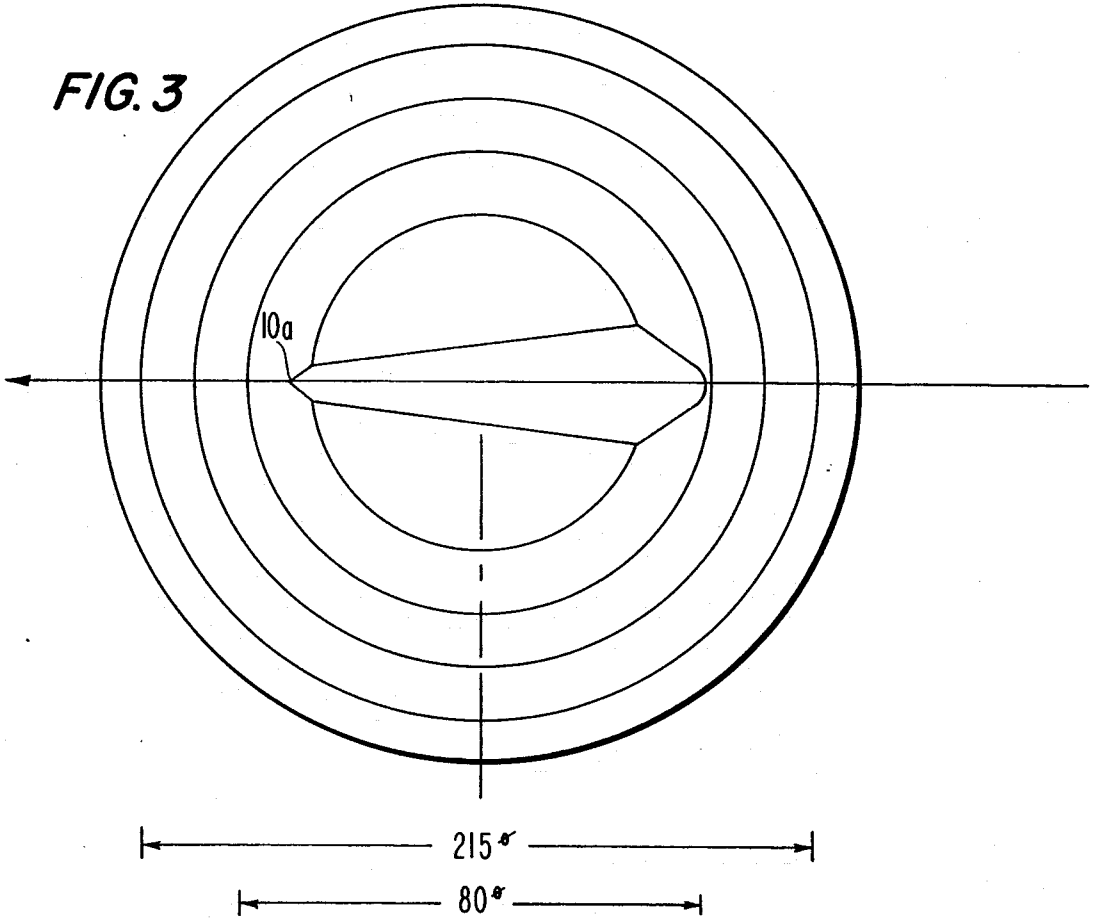
FIG. 3 is a plan view of the foam body with a centering aid.

Wedge-shaped areas 17a of pointers 10a (FIG. 3) on the top end surface are inclined 45° from vertical axis X. The wedgeshaped pointer integrated in the top surface indicates the position or the angle at which the device, or the system of microphone capsules, exhibits its best acoustic properties. At the optimum position, the pointer may conveniently be parallel to the guitar strings, with its apex pointing to the guitar neck.

Foam body 1 consists of two sections 12a, 13a of about the same height, which are adapted to be adhesively bonded and in their joined condition define a cavity 7a for receiving electronic circuitry. Cavity 7a in top section 13a of foam body, which receives the electronics, has a diameter of 40 mm and a height of 15 mm. A cable 8a is introduced into cavity 7a from outside the top end surface of the foam body for connection to the electronic circuitry. After this case and microphone capsules, connected thereto through leads, have been inserted into recesses provided therefor, the two sections are adhesively bonded to each other to create a closed-surface body from which only the leads protrude, i.e. the microphone capsules are not visible. The electronics case in the upper section of the foam body also fulfils the functions of a relief anchor for the externally extending cable. In the event of sudden tension (as may be caused by a person stepping on the cable), it takes up the tension forces and prevents the microphone capsules and the electronics connected thereto from being jerked from their seats. As the case is much bigger than the capsules, its seat (adhesive bond) may take up much higher forces.

Figure 2:
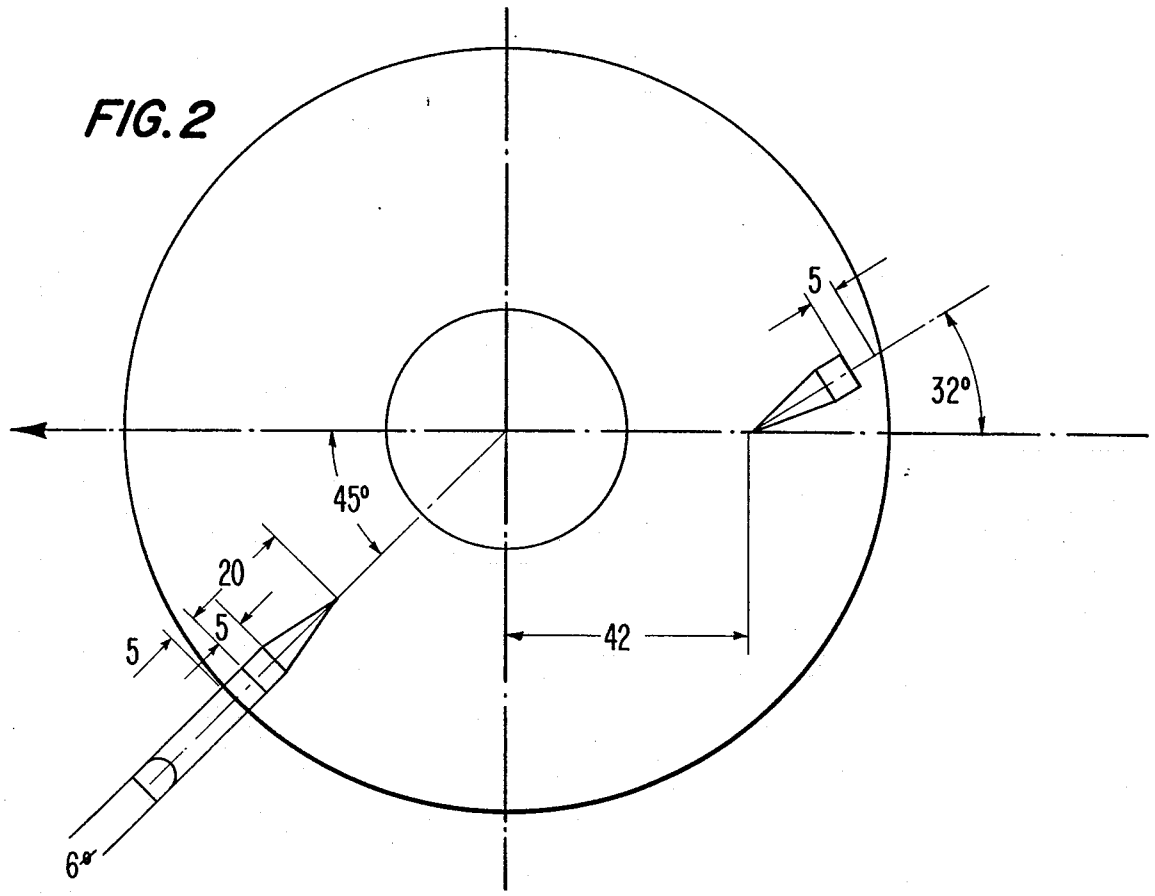
FIG. 2 is a centered device.

FIG. 2 shows a possibility of centering the device inside the sound hole. Integrated wedge-shaped pointer 10a shown in FIGS. 2 and 3 indicates the desired assembly position.

Figure 4:
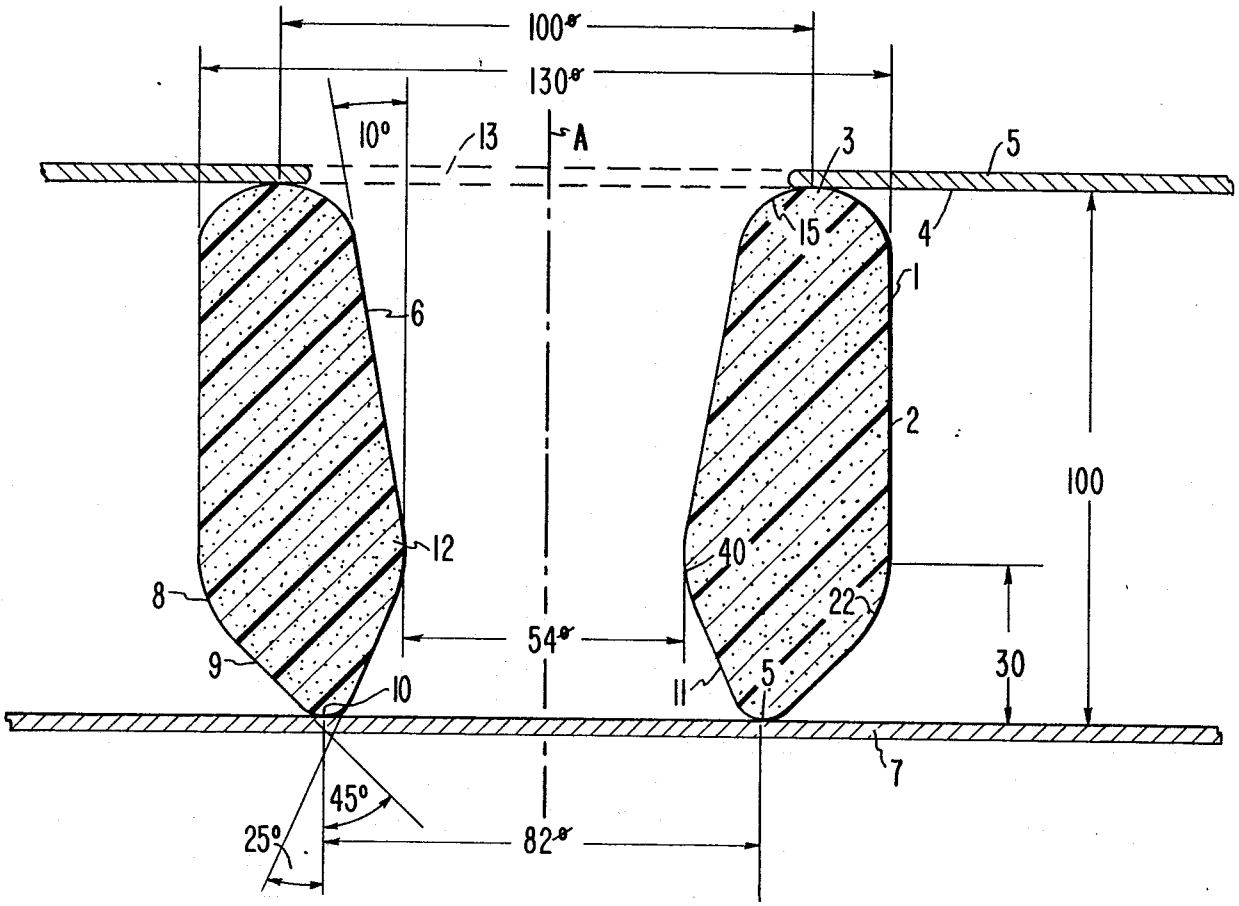
FIG. 4 is a sectional view showing the foam body of a second embodiment of the device secured in place in the soundbox of a stringed instrument.

The sectional view of FIG. 4 shows the annular open-cell foam body 1 of a second embodiment of the inventive recorder. The body may be formed from a single member with the peripheral surface 2 being cylindrical and having a diameter of 130 mm in the preferred second embodiment shown. At the top of annular foam body 1, peripheral surface 2 merges with a concentric top ridge 3, semi-circular in cross section, and which will engage inner surface 4 of top wall 5 of the stringed instrument's soundbox along a circular line. The diameter of the circular line in FIG. 4 is 100 mm. The radius of the top semi-circular ridge 3 is 15 mm. On the inside, top semi-circular ridge 3 merges with an inner peripheral surface 6 tapered at a 10° angle relative to the vertical axis of foam body 1 and having a diameter of 54 mm at its bottom end. Foam body 1 has a height of 100 mm, with the circular cylindrical peripheral surface 2 extending downwardly to a position 30 mm above bottom wall 7 of the soundbox of the stringed instrument.

Outer peripheral surface 2 merges at its bottom end with a portion 7 inwardly curved to a 22 mm radius of curvature which in turn continues in a rectilinear portion 9 inwardly inclined at a 45° angle relative to vertical axis A of foam body 1. That latter portion finally merges with a lower concentric ridge 10 having a semicircular cross section and a 5 mm radius which will engage bottom wall 7 of the soundbox of the stringed instrument along a circular line, that circular line having a diameter of 82 mm. At its upper end, bottom semicircular ridge 10 merges with a rectilinear portion 11 upwardly inclined at a 25° angle relative to the vertical axis of foam body 1, that portion 11 in turn being extended upwardly by a portion 12 curved on a 40 mm radius and merging with the end of the downwardly conical inner peripheral surface 6 of the foam body 1 at a height 30 mm above soundbox bottom 7.

Foam body 1 compresses readily and may be introduced easily through sound hole 13 into the soundbox of the stringed instrument. Its elasticity will cause it to be clamped safely in position by its line contact with bottom 7 and top 5 of the soundbox. As shown in FIG. 4, the diameter of sound hole 13 is somewhat less than 100 mm. Being semi-circular in cross section at the top and at the bottom of the annular foam body, the ridges will conform readily to sharp-edged protruding members such as stiffening components on the top and bottom walls of the soundbox. Because of their shape rigidity, they are easy to manufacture. Also, the ridges improve the foam body's appearance. An improved appearance is also achieved if the foam body is colored black and seated in the sound hole so that its inner periphery is aligned with the edges thereof, such that it will hardly be noticed.

Figure 5:
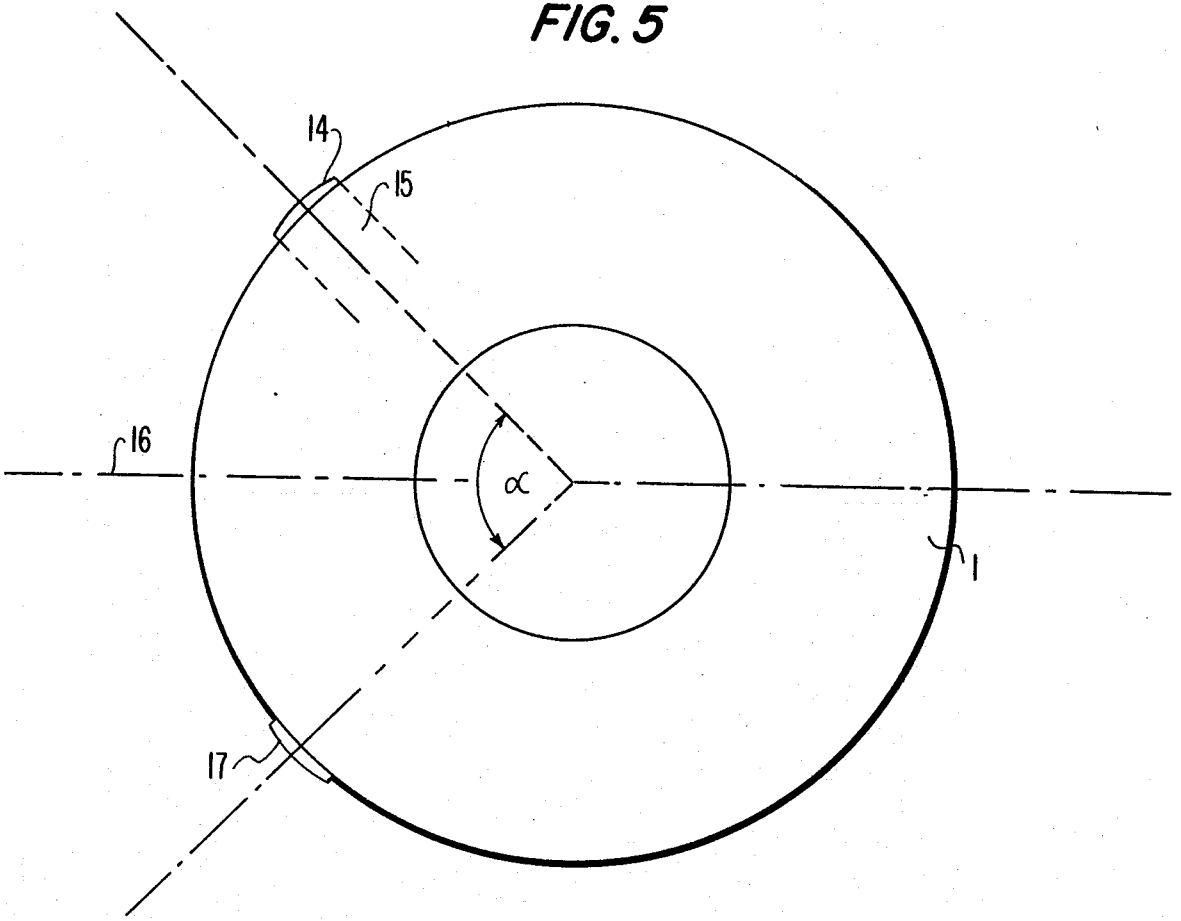
FIG. 5 is a plan view of the foam material body of the second embodiment, depicting the 90° relationship of the two microphones.

As shown in FIG. 5, two microphones 14 are located in passage-like cavities 15 radially extending through foam body 1 to describe an opening angle $\alpha$ of 90°, with bisector 16 of opening angle $\alpha$ coinciding with the diameter of sound hole 13 which extends in the direction of the longitudinal axis of the guitar's fingerboard.

The assembly of two microphones in the annular foam body at a mutual opening angle of 90° creates a stereo effect which is enhanced by the bisector of that angle extending in parallel with and between the two center strings of the guitar. The microphones lie symmetrically with respect to the bisector and are at the same time directed into the major portion of the soundbox. Microphones 14, of which membranes 17 are spaced 90° along peripheral surface 2 of foam body 1, are seated in valve feet 18 symmetrically located with respect to the aforesaid diameter direction. Microphones 14 are directed into the large portion of the soundbox. Being pre-assembled in the valve feet and having their leads attached thereto in the final condition, the microphones may be introduced through the central opening into the passage-like cavities extending radially outwardly through the peripheral surface.

The acoustic properties in the sound pickup process are improved in that the considerable reduction in foam body volume—as caused by the centered and preferably circular through-opening having a diameter conventional for sound holes—reduces the damping of the air volume vibrating inside the guitar's soundbox and keeps the sound hole open. As the sound hole is not covered up by the foam material of the foam body, the latter affects the natural sound of the guitar to a much lesser extent that would a solid foam body. For this reason, it is possible for the microphones to render the guitar's natural sound much better. Without the player having to remove the foam body from the soundbox, he/she can now play with the microphones disconnected and still preserve virtually all of the instrument's quality as the stings clearly vibrate longer and "more freely", providing a greater amount of echo.

Figure 6:
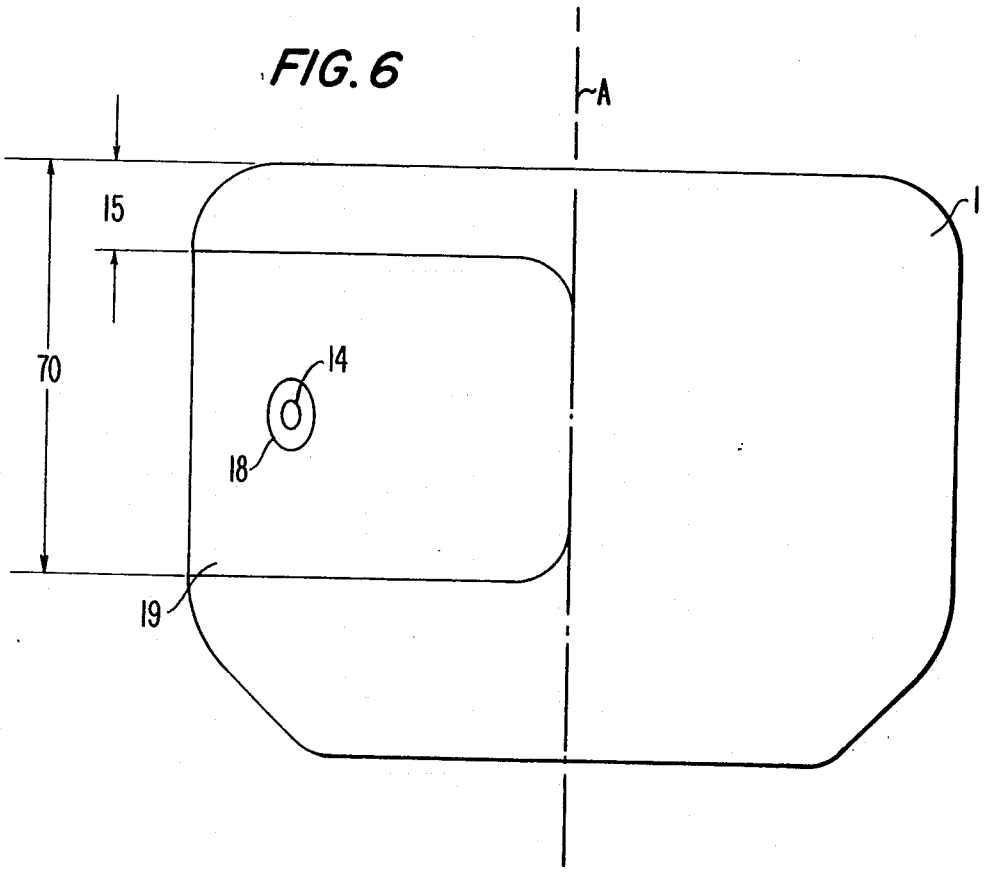
FIG. 6 is a side view of the foam body of the second embodiment having an elastic skin applied to the outer surface thereof.
Figure 7B:
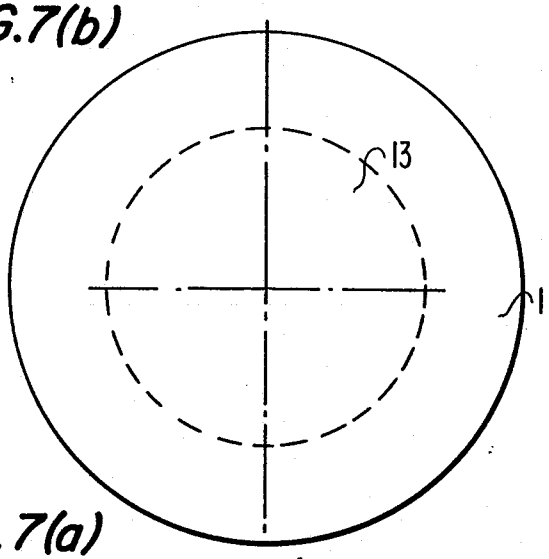
FIG. 7*b* is a plan view of the foam body of FIG. 7*a*.
Figure 7A:
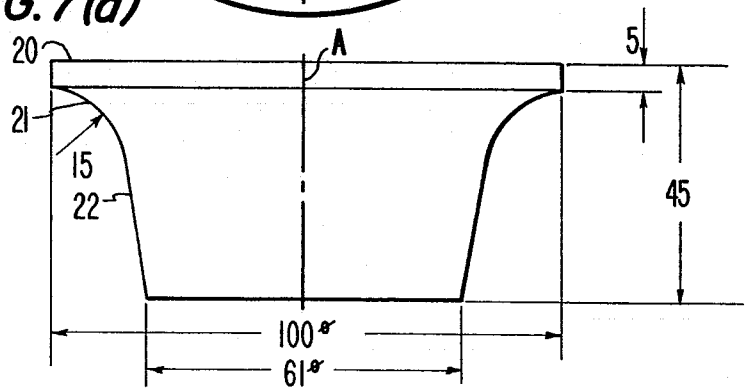
FIG. 7*a* is a partial longitudinal section showing a plug of a fine-pore foam material introduced in the top of the centered opening in the annular foam body.
Figures 8A, 8B:
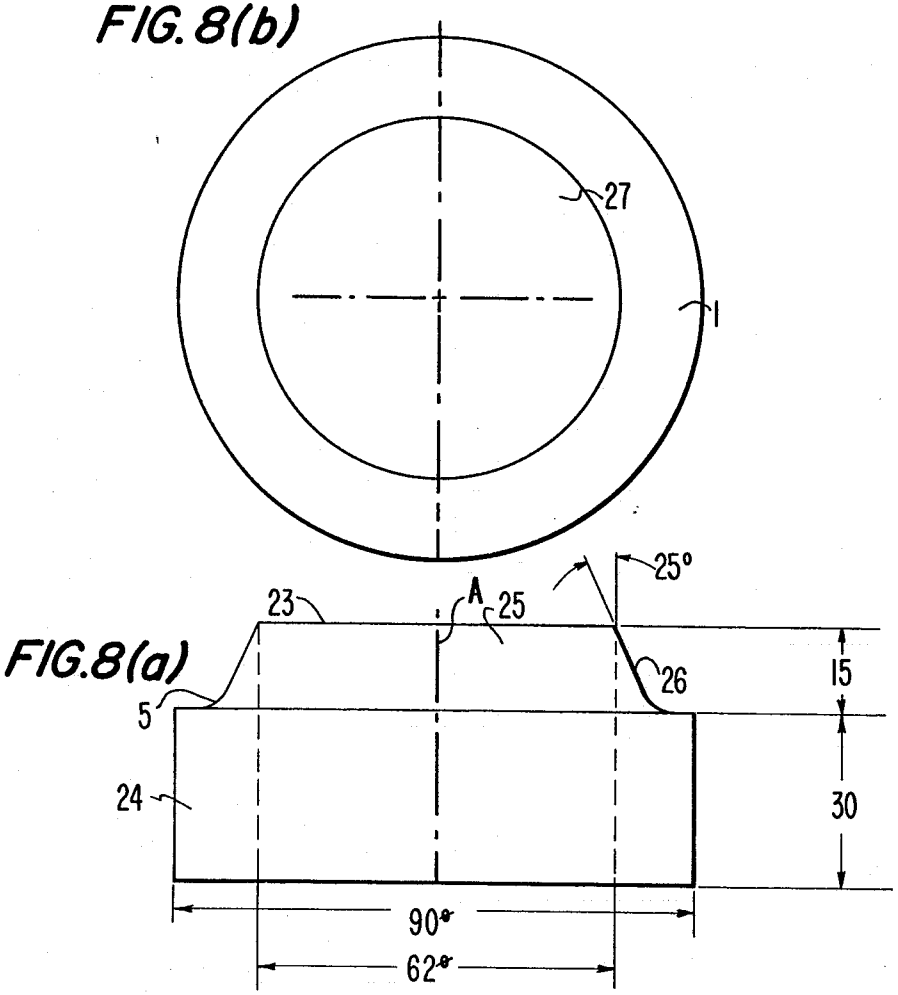
FIG. 8*a* is a side view of a pedestal-like open-cell foam member adapted to have the annular foam body seated thereon in a flush manner.
FIG. 8*b* is a plan view of the annular foam body in association with the pedestal-like base member of FIG. 8*a*.
Figure 9B:
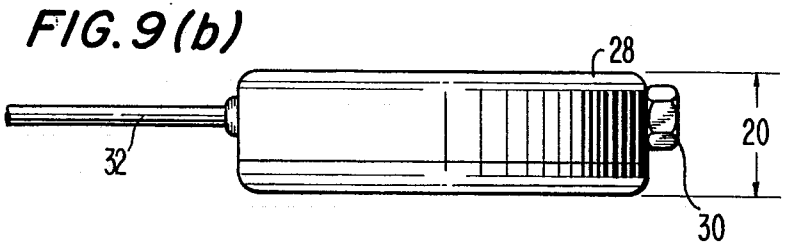
FIG. 9*b* is a side view of the case of FIG. 9*a*.
Figure 9A:
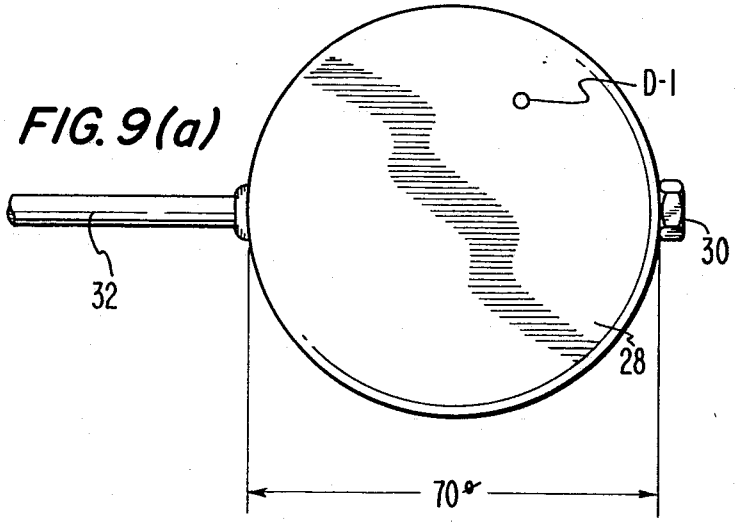
FIG. 9*a* is a plan view of the case housing the electronic components.

As shown in FIG. 6, one half of the substantially cylindrical outer peripheral surface 2 of annular foam body 1 has applied and bonded thereto an elastic closed skin 19. Membranes 17 of microphones 14, which are each received by the central opening of a valve of the type commonly used in bicycle tire inner tubes, lie in a plane with skin 19. Elastic skin 19 is stretched taught over foot 18 of each valve and the microphone 14 therein. As shown in FIG. 6, skin 19 extends in the direction of vertical axis A of annular foam body 1 from 15 mm to 70 mm below the top edge of foam body 1.

This arrangement reduces the overall manufacturing expense and results in a relatively low-cost sound pickup device.

The elastic closed-surface skin applied to the body's outer surface by a specialized process generates a boundary surface effect by reflecting incident sound. Having preassigned dimensions, the skin surface will substantially reflect higher-frequency components having correspondingly shorter wavelengths. The reflected components will add in phase to the non-reflected sound arriving at the microphones directly from the sources because the microphone membranes lie in the plane of the skin. This will enhance higher-frequency sound components—an effect desirable in guitars, whose resonance usually is in the lower portions of the spectrum.

FIG. *7a* shows a plug 20 of fine-pored foam material which, in the event the user plays his/her guitar together with other very loud instruments, may be used to reduce feedback from the level obtainable with the De Byl device alone, by seating the plug inside top centered circular opening 21 in foam body 1 (FIG. *7b*) so as to seal it. Plug 20 has a top circular cylindrical plate-shaped portion having a diameter of 100 mm and a height of 5 mm which continues to a portion 21 curved inwardly on a radius of 15 mm; portion 21 in turn merges with a downwardly tapered portion 22 having a diameter of 61 mm at its bottom end. In the direction of vertical axis A plug 20 has a height of 45 mm. This plug permits high-gain amplification or high volume for loudspeaker reproduction while minimizing any loss of natural sound quality.

In some specialized guitars, the distance between top wall 5 and bottom wall 7 of the soundbox may be greater than in classical guitars. In this case, annular foam body 1 (FIG. *8b*) may be placed on a pedestal-like plug member 23 formed of foam material (FIG. *8a*) which may be placed on bottom wall 7 of the soundbox. As shown in FIG. *8a*, pedestal-like foam member 23 has a circular cylindrical base portion 23 preferably 90 mm in diameter and 30 mm high in the direction of the vertical axis, that base portion merging upwardly with a portion 25 curved on a 5 mm radius which in turn continues to a portion 26 upwardly tapered with a 25° angle relative to vertical axis A. At its top end, portion 26 has a diameter of 62 mm. Portions 25, 26 form a suitable protrusion or boss element to extend flush into the lower end of centered opening 27 in annular foam body 1 (FIG. *8b*). Boss 25, 26 is 15 mm high in the direction of vertical axis A. In this manner, the annular foam body may be used in specialized guitars, too, without its dimensions having to be altered.

Figure 10:
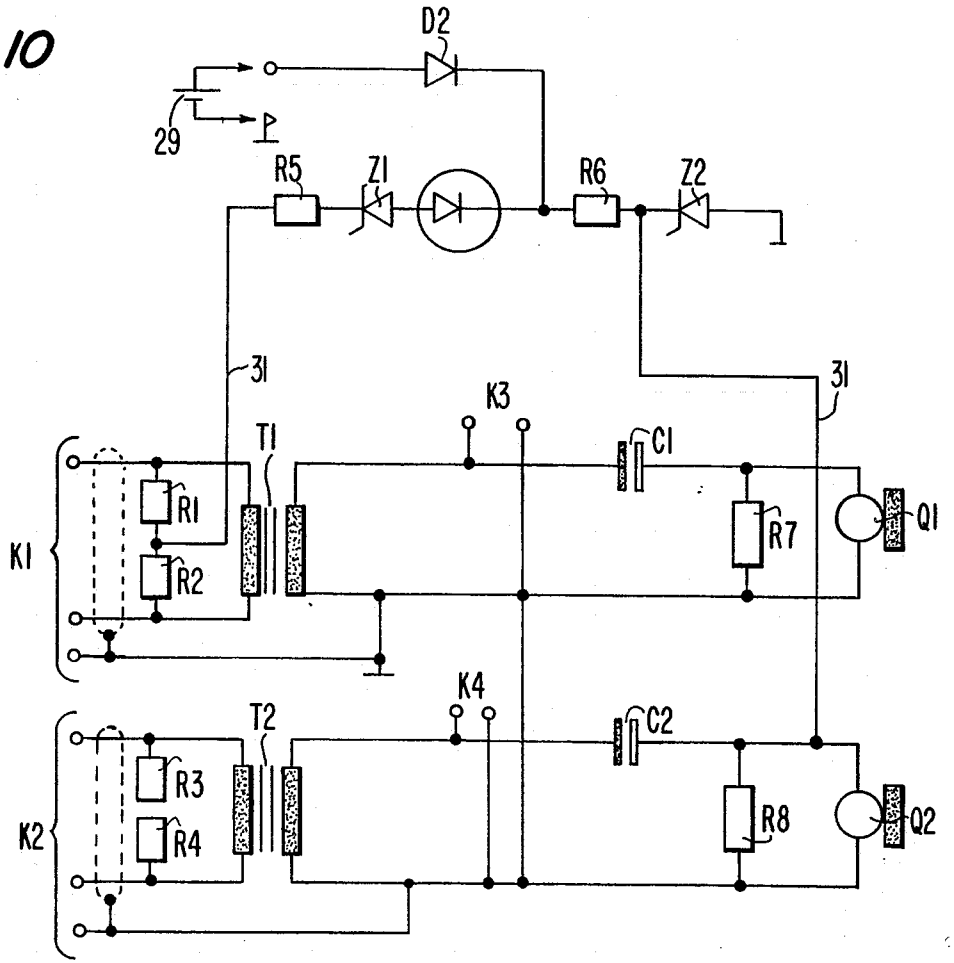
FIG. 10 is the circuit diagram of the electronic system, including the alternate power supply schemes for the device.

In plan and elevation, respectively, FIGS. *9a*, *9b* show a case 28 for containing the electronic components of the pickup device. This case 28 is made of mu metal, is relatively small and sturdy in construction and receives a 9V battery block 29 (FIG. 10). Mu metal case 28 protects the electronics inside, of which the circuit diagram is shown in FIG. 10, against external electromagnetic noise fields. On the output side, case 28 has a commercial multi-pole miniaturized flange-type socket connector 30 for all output terminals. On the input side, a multi-wire cable is provided for all inputs. Case 28 has a diameter of 70 mm (FIG. *9a*) and a height of 20 mm (FIG. *9b*). The use of commercial multi-pole miniaturized flanged socket connectors on all outputs and of an additional miniaturized flanged socket connector or of a multi-connector cable on all inputs results in relatively small geometric dimensions of the case housing the sound pickup device electronics.

If it is intended to supply the present sound pickup device with power independent from the customary phantom feed, electronic means are provided to automatically switch to a battery pack in the case housing the pickup electronics as soon as the phantom circuit is disconnected. The electronic circuit includes light-emitting diodes to visually indicate the active feed system (battery or phantom). Additionally, this electronic circuit matches the output impedance of the microphones to 200Ω balanced and to 20kΩ unbalanced to allow for connection to conventional mixing equipment as well as to instrument amplifiers.

FIG. 10 shows the interconnections of the electronic components in the recorder assembly for the selective supply of power by a battery block 29 housed in case 28 or by a phantom arrangement.

The electronics of the inventive recorder assembly preferably use hybrid technology including two microphone transformers. Potting with an epoxy resin-based compound will ensure minimum geometric dimensions and high mechanical strength, as required for rough on-stage usage. The case is small and sturdy and accommodates a 9 Volt battery block. FIG. 10 shows two outputs K1, K2 to mixing equipment inputs using the phantom power supply scheme of DIN Standard No. 45596 (200 ohms balanced), to each of which may be connected a back electret microphone capsule Q1 or Q2 through audio transformer T1 or T2 for impedance transformation. Two pairs of metal-film resistors R1, R2 as well as R3, R4 are connected across the primary of each audio section T1 or T2. An electrolytic capacitor C1 or C2 is connected in series with the secondary of audio section T1 or T2 and back electret capsule Q1 or Q2 has a metal-film resistor R7 or R8 connected thereacross in the line circuit. Outputs K3, K4 (20 kilohms unbalanced) for instrument amplifier inputs are provided in the secondary line branch of audio sections T1, T2, each of which is also coupled through a grounded direct connection to mixing equipment outputs K1, K2. From the common terminal of metal-film resistors R1, R2 at the primary circuit portion of audio section T1, a line 31 is taken through a series connection of a metal-film resistor R5, a Zener diode Z1, a light-emitting diode D1 for indicating phantom operation and a metal-film resistor R6 to back electret capsule Q2. The back electret capsule is also connected to line 30. The output of metal-film resistor R6 is taken to ground through a Zener diode Z2. Through a protective silicon diode, battery block 29 is connected to line 31 at the node between light-emitting diode D1 (for signalling phantom operation) and metal-film resistor R6.

I claim:

1. A sound pickup device for acoustic stringed instruments, comprising:

an elastic foam body, said body having an outer peripheral wall and top and bottom ends, each of said top and bottom ends having at least one projection extending therefrom, whereby said body will be retained within a soundbox of an acoustic stringed instrument by abutment of said projections against interior walls of the soundbox;

microphone means connected to said body; and means for connecting said microphone means to external equipment, said means for connecting being connected to said body.

2. A device as in claim 1, wherein said outer peripheral wall is substantially circular and each said projection is an annular ridge.

3. A device as in claim 2, wherein said at least one annular ridge extending from said top and comprises two concentric annular ridges extending coaxially therefrom.

4. A device as in claim 3, wherein one of said two concentric annular ridges extends a distance greater than the other of said two concentric annular ridges.

5. A device as in claim 4, wherein said one of said two concentric annular ridges is the radially exterior one of said two concentric annular ridges.

6. A device as in claim 2, wherein the cross-sectional thickness of each of said ridges decreases in the respective direction in which said ridge extends.

7. A device as in claim 1, wherein said body is coated with velvet.

8. A device as in claim 1, wherein said body further includes at least one microphone cavity, and said microphone means includes at least one microphone, each said microphone being mounted in a respective one of said microphone cavities.

9. A device as in claim 1, wherein said body further includes a body cavity within said body, at least a portion of said means for connecting being mounted in said body cavity.

10. A device as in claim 9, wherein said body is formed of two adhesively joined elastic foam parts, at least one of said parts having a recess in a joining surface thereof, said recess constituting said body cavity.

11. A device as in claim 1, wherein said body further includes a pointer on the top end thereof, said pointer having a defined angular relationship with said microphone means to thereby indicate the properly installed angular position of said body within the soundbox.

12. A sound pickup device for acoustic stringed instruments, comprising:

an elastic foam body, said body comprising a closed peripheral wall defining a central opening therethrough, whereby said body will be retained within a soundbox of an acoustic stringed instrument by abuttment of longitudinal ends thereof against interior walls of the soundbox;

microphone means connected to said body; and means for connecting said microphone means to external equipment, said means for connecting being connected to said body.

13. A device as in claim 12, wherein said wall is substantially circular, whereby said body is substantially tubular.

14. A device as in claim 13, wherein the longitudinal annular edges of said body are rounded to thereby provide annular line contact with the interior walls of the soundbox when mounted therein.

15. A device as in claim 13, wherein said microphone means comprises two microphones, sound receiving portions of each of said microphones being directed radially outwardly from said tubular body and angularly spaced by approximately 90°.

16. A device as in claim 12, further comprising a closed elastic skin bonded to a portion of the external wall surface of said body.

17. A device as in claim 12, in combination with an elastic foam plug, said plug having a first portion substantially corresponding in shape to, and inserted in, said central opening of said body, and a second portion, said second portion having a first side adjacent said first portion and abutting against said body, and a second side opposite said first side and adapted to abut against the interior wall of the soundbox.

* * * * *